United States Patent [19]

Kato et al.

[11] Patent Number: 4,534,323

[45] Date of Patent: Aug. 13, 1985

[54] VALVE OPERATION CHANGING SYSTEM OF INTERNAL COMBUSTION ENGINE

[75] Inventors: Manabu Kato, Tokyo; Shunichi Aoyama, Yokosuka, both of Japan

[73] Assignee: Nissan Motor Co., Ltd., Yokohama City, Japan

[21] Appl. No.: 552,832

[22] Filed: Nov. 17, 1983

[30] Foreign Application Priority Data

Dec. 23, 1982 [JP] Japan ..... 57-231202
Mar. 28, 1983 [JP] Japan ..... 58-50390

[51] Int. Cl.[3] ..... F01L 1/34

[52] U.S. Cl. ..... 123/90.16; 123/90.44; 123/198 F

[58] Field of Search ..... 123/90.16, 90.39, 198 F, 123/90.18, 90.27, 90.44

[56] References Cited

U.S. PATENT DOCUMENTS 3,730,150 5/1973 Codner, Jr. ..... 123/90.18
4,253,434 3/1981 Takizawa et al. ..... 123/90.16 X
4,354,460 10/1982 Mae et al. ..... 123/90.16

FOREIGN PATENT DOCUMENTS 52-44314 4/1977 Japan .
52-124307 9/1977 Japan .
54-127012 9/1979 Japan .
54-140015 10/1979 Japan .
55-96310 7/1980 Japan ..... 123/90.18
55-148911 11/1980 Japan ..... 123/90.16

*Primary Examiner*—William R. Cline
*Assistant Examiner*—Peggy A. Neils
*Attorney, Agent, or Firm*—Schwartz, Jeffery, Schwaab, Mack, Blumenthal & Evans

[57] ABSTRACT

A valve operation changing system of an internal combustion engine, comprises a rocker arm to operate an intake or exhaust valve, and a control device for axially moving the rocker arm so as to selectively cause the rocker arm to engage with first or second cam in accordance with an engine operating condition. The control device includes an actuator having first and second hydraulic pressure chambers whose pressures move the rocker arm to engage with the first and second cams, respectively. A flow direction changing valve is provided to selectively supply the first or second hydraulic pressure chambers with oil from an oil pressure source, in accordance with the engine operating condition. Additionally, a flow control valve is disposed in an oil passage connecting the flow direction changing valve with the second hydraulic pressure chamber and openable to allow oil flow through the oil passage in accordance with the rotational position of the camshaft cams, thereby precisely regulating rocker arm transferring timing so as not to overlap the lift of the camshaft cams.

34 Claims, 16 Drawing Figures

VALVE OPERATION CHANGING SYSTEM OF INTERNAL COMBUSTION ENGINE

BACKGROUND OF THE INVENTION

1. Field of the Invention

This invention relates to an improvement in a valve operation changing system for changing the valve timings of intake and/or exhaust valve of an internal combustion engine in accordance with engine operating conditions, and more particularly to a hydraulic system for controlling the transfer of a rocker arm from a first position to a second position, and vice versa at a higher speed and at a predetermined suitable timing.

2. Description of the Prior Art

Valve operation changing systems have been applied to various uses in the field of internal combustion engines. For example, the valve operation changing system is used in a so-called dual-mode engine which is so arranged that the valve timing of intake and exhaust valve is changed at a light load engine operating range so as to deactivate some cylinders, thereby carrying out a part-load engine operation.

In general, a gasoline engine of the type wherein a charge is previously prepared by mixing air and fuel has a tendency that good fuel economy is obtained at a high engine load operating range. In this regard, in the dual-mode engine, the intake and exhaust valves of some cylinders are kept fully closed to interrupt the supply of air and fuel thereinto thereby to deactivate the cylinders. This relatively increases engine load applied to the remaining cylinders, improving combustion and reducing pumping loss. This effectively improves fuel economy of the engine at the light load engine operating range.

The valve timing changing of the intake and exhaust valves of the dual-mode engine is usually carried out by transferring rocker arms from a first cam for cylinder activation or working onto a second cam for cylinder deactivation or rest in accordance with the engine operating conditions. The first and second cams are formed on a single camshaft and located side by side.

Since the transferring of the rocker arms are usually carried out by the biasing force of springs, it is difficult to obtain a sufficient moving speed of the rocker arms, thereby rendering difficult the valve timing changing during a high engine speed engine operation. Besides, there is a fear of the rocker arms and/or cams being damaged due to the fact that valve lift is initiated by the cam at a timing at which the movement of the rocker arm has not yet been terminated. This impairs the reliability and durability of the conventional valve operation changing system.

SUMMARY OF THE INVENTION

A valve operation changing system according to the present invention comprises first and second cams formed on a camshaft and different in cam profile from each other. A rocker arm is mounted on a rocker shaft and swingable around the rocker shaft upon contact with the first and second cams. The rocker arm is also movable in the axial direction of the rocker shaft so as to contact with the first cam when the rocker arm is put in a first position while with the second cam when the rocker arm is put in a second position. Additionally, a control device is provided to selectively put the rocker arm in one of the first and second positions in accordance with an engine operating condition.

The control device includes first and second hydraulic pressure chambers which are fluidly connectable with an oil pressure source to be supplied with pressurized oil. The first hydraulic pressure chamber causes the rocker arm to be put into the first position when fluidly connected with the oil pressure source, while the second hydraulic pressure chamber causes the rocker arm to be put into the second position when fluidly connected with the oil pressure source. A flow direction changing valve is fluidly interposed between the oil pressure source and the first and second hydraulic pressure chambers. The flow direction changing valve selectively takes one of a first state to fluidly connect the first hydraulic pressure chamber with the oil pressure source and a second state to fluidly connect the second hydraulic pressure chamber with the oil pressure source. Additionally, a flow control valve is fluidly interposed between the flow direction changing valve and the second hydraulic pressure chamber, and is arranged to be openable to fluidly connect the flow direction changing valve with the second hydraulic pressure chamber in accordance with the rotation of the camshaft.

Accordingly, by virtue of the flow control valve, rocker arm transferring timing is so precisely regulated as not to overlap the lift of the camshaft cams, thereby avoiding the collision and rubbing contact with a high frictional force between the rocker arm and the cam. This effectively prevents the rocker arm and/or the cam from damage or breakage, thus attaining the reliability and durability of the valve operation changing system.

BRIEF DESCRIPTION OF THE DRAWINGS

The features and advantages of the valve operating changing system according to the present invention will be more clearly appreciated from the following description taken in conjunction with the accompanying drawings in which like reference numerals designate like parts and elements throughout all the drawings, and in which.

DETAILED DESCRIPTION OF THE INVENTION

To facilitate understanding the present invention, a brief reference will be made to a so-called dual-mode internal combustion engine provided with a conventional valve operation changing system, with reference to FIGS. 1 to 3.

Figure 1:
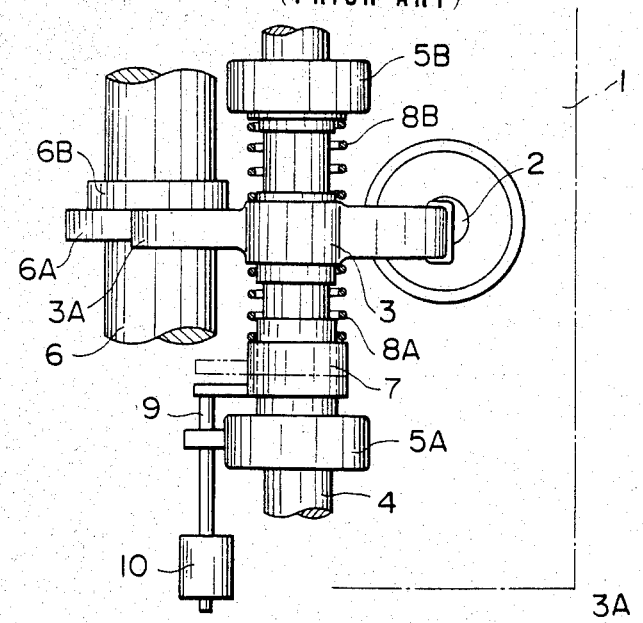
FIG.1 (PRIOR ART)
FIG. 1 is a plan view of a conventional valve operation changing system.
Figure 2:
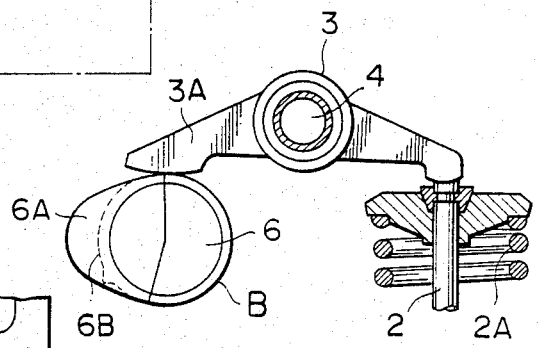
FIG.2 (PRIOR ART)
FIG. 2 is a front elevation of the system of FIG. 1.
Figure 3:
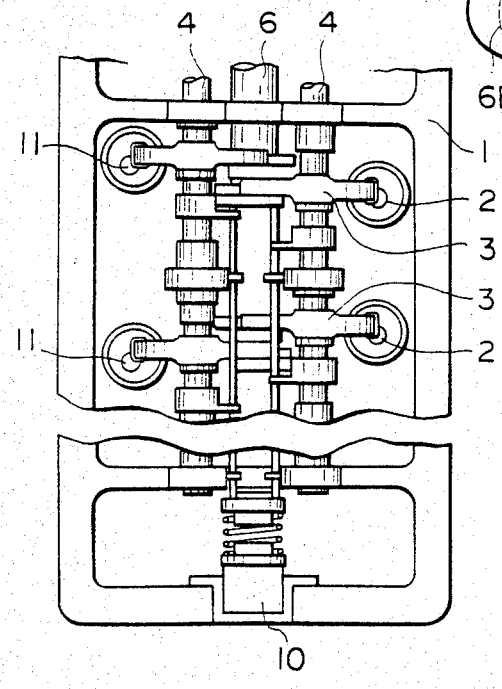
FIG.3 (PRIOR ART)
FIG. 3 is a plan view of an essential part of a dual-mode engine equipped with the conventional valve operation changing system of FIG. 1.

As depicted in FIGS. 1 to 3, a cylinder head 1 is provided with an intake valve 2 in cooperation with a cylinder (not shown). A rocker arm 3 is rotatably mounted on a rocker shaft 4. The rocker shaft 4 is rotatably supported through brackets 5A, 5B by the cylinder head 1. The reference numeral 6 denotes a camshaft. The camshaft 6 is formed with first and second cams 6A, 6B located side by side. The first cam 6A has a cam profile for opening the intake valve 2 through the rocker arm 3 in a manner indicated in FIG. 4A at the intake stroke during the working or activation of the cylinder, under the cooperation of a valve spring 2A shown in FIG. 2. The second cam 6B has a cam profile for opening the intake valve 2 through the rocker arm 3 only in a manner indicated in FIG. 4B at the terminal stage (at the piston location in the vicinity of bottom dead center) of the intake stroke during the rest or deactivation of the cylinder. In this case, the cylinder is arranged to be put into the rest or deactivated condition when the engine is operated at a light load engine operating range. The rocker arm 3 is swingable relative to the rocker shaft 4, and elastically supported between the brackets 5A, 5B under the action of first and second springs 8A, 8B so as to be movable in the axial direction of the rocker shaft 4, i.e., in the upward and downward direction in the drawing. More specifically, a changing ring 7 for changing the location of the rocker arm 3 is slidably mounted on the rocker shaft 4 and arranged to be slidable in the axial direction of the rocker shaft 4 between the rocker arm 3 and the bracket 5A. Accordingly, locating the changing ring 7 is achieved under the balance of tension between the first spring 8A and the second spring 8B. The first spring 8A is located between the changing ring 7 and the rocker arm 3, while the second spring 8B is located between the bracket 5B and the rocker arm 3.

Figure 4A:
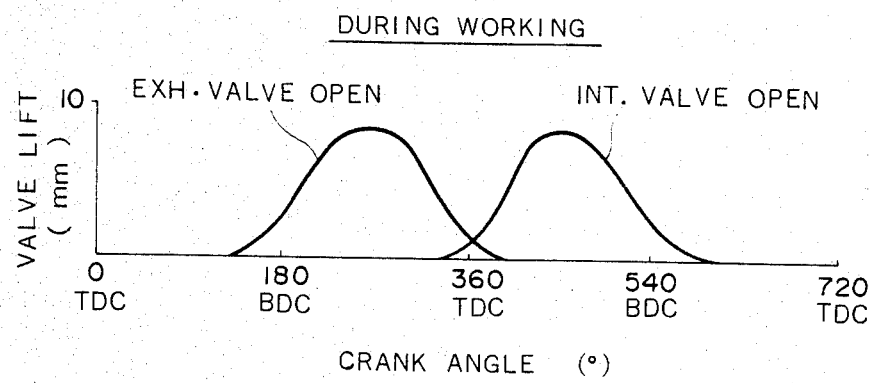
FIG. 4A is a graphical representation showing the valve timings of intake and exhaust valves during cylinder working or activation.

The changing ring 7 is actuated through a rod 9 by an actuator 10 which includes a solenoid or hydraulic cylinder. The actuator 10 in this case is adapted to move the changing ring 7 into a location indicated in phantom in FIG. 1 in order to cause the rocker arm 3 to contact with the second cam 6B. Thus, during the working of the cylinder, the changing ring 7 is arranged to locate the rocker arm 3 on the first cam 6A so as to open or close the intake valve 2 in accordance with the cam profile of the first cam 6A as shown in FIG. 4A. From this state, when the changing ring 7 is moved toward the bracket 5B under the driving force of the actuator 10, the springs 8A, 8B are compressed to push the rocker arm 3 so that the rocker arm 3 moves onto the second cam 6B during the time period at which a follower section 3A of the rocker arm 3 resides in the base circle area B of the cam profile of the cam 6A. In this state, the intake valve 2 opens a slight time period at the terminal stage (at the piston location of bottom dead center) of intake stroke in accordance with the cam profile of the second cam 6B as shown in FIG. 2B.

A similar valve operation changing system is provided also for an exhaust valve 11, so that the exhaust valve 11 opens at the exhaust stroke during the working of the cylinder in a manner indicated in FIG. 4A, whereas closes during the rest of the cylinder.

Figure 4B:
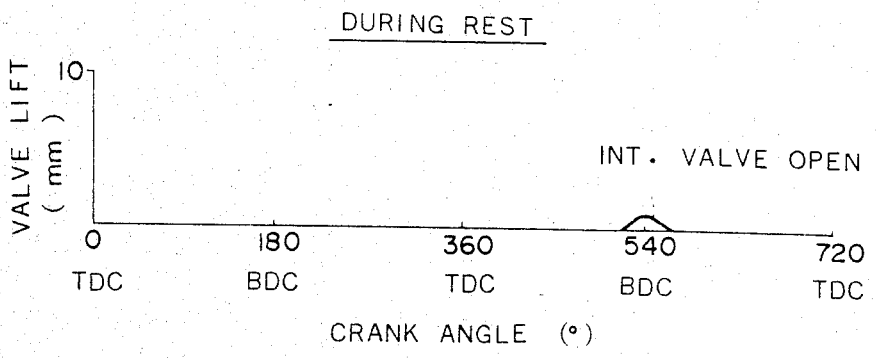
FIG. 4B is a graphical representation showing the valve timing of the intake valve during cylinder rest or deactivation.

Thus, when the actuator 10 is operated at the light load engine operating range, the intake and exhaust actions of cylinders at rest are regulated, thereby preventing the cylinders at rest from being supplied with air-fuel mixture. Accordingly, combustion does not take place in the cylinders at rest, and simultaneously the air-fuel mixture not supplied to the cylinders is inducted into the working cylinders, thus relatively increasing the load applied to the working cylinders. As a result, good fuel economy characteritics can totally be obtained preventing a decrease in engine power output. It will be understood that the reason why the intake valve 2 of the cylinder at rest is slightly opened as shown in FIG. 4B is that an increase in difference between the torques generated at the rest cylinders and the working cylinders is prevented by supplying gas into the rest cylinders thereby to increase compression work in the same cylinders.

However, the following drawbacks are encountered with the above-discussed conventional valve operation changing system:

In connection with the fact that the movement of the rocker arms is made by the biasing force of the springs, it is difficult to obtain a sufficient spring biasing force, for example, for the reason of a restricted space for installation. This unavoidably reduces the moving speed of the rocker arms, thereby rendering difficult the valve operation changing during a high engine speed operation. Besides, the actuator is required to be considerably large-sized in order to function as corresponding to the spring. Furthermore, it will be caused at certain actuator operation timing, that the rocker arm follower section and/or the cam is damaged due to the fact that the valve lift or the rocker arm swingable movement is initiated by the cam at a timing at which the movement of the rocker arm has not yet completed, excessively increasing the pressure applied per unit area at the contact faces of the rocker arm follower section and the cams. This impairs the reliability and durability of the conventional valve operation changing system.

Figure 5:
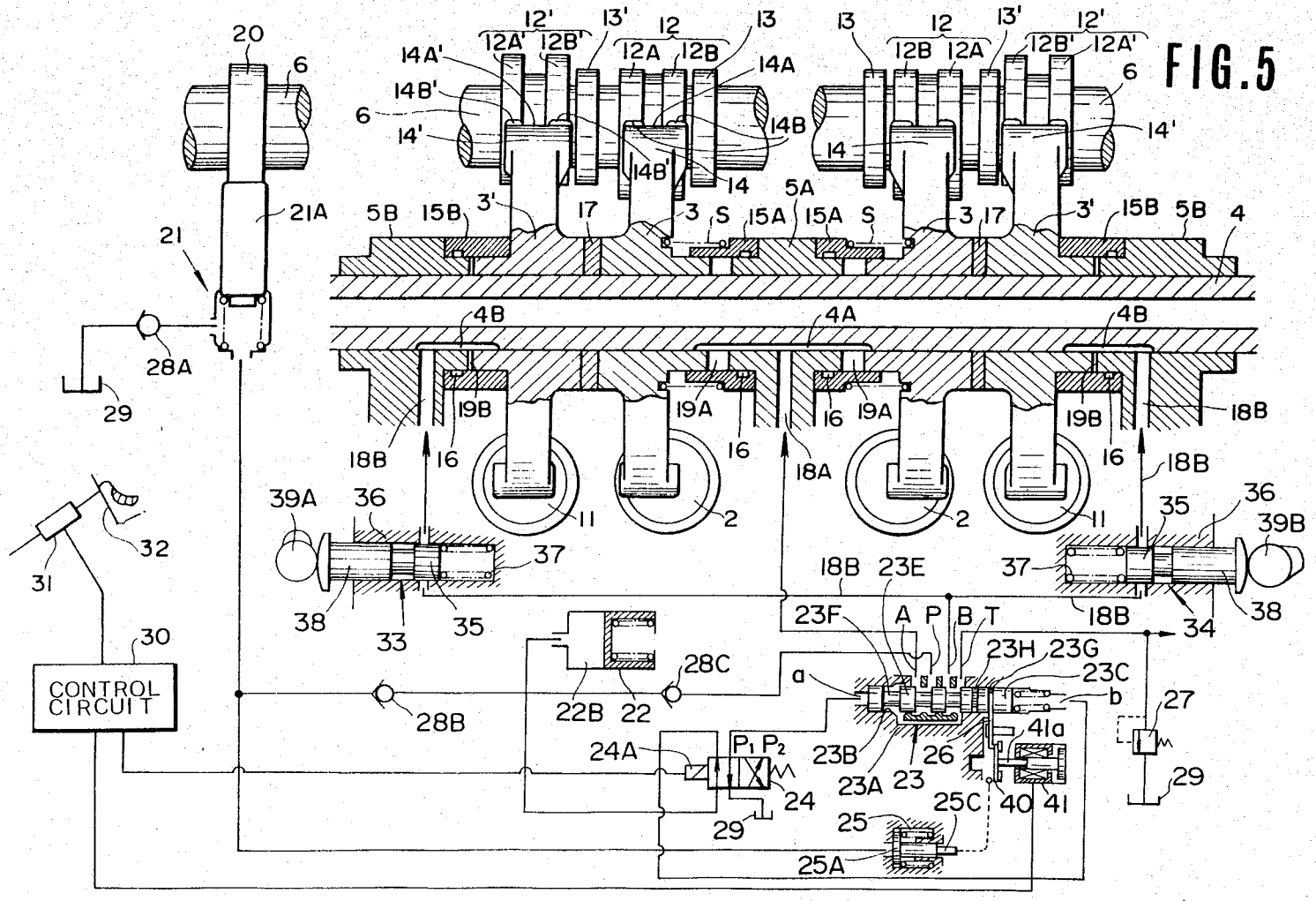
FIG. 5 is a diagrammatic illustration of an embodiment of the valve operation changing system in accordance with the present invention, mounted on a dual-mode engine.
Figure 6A:
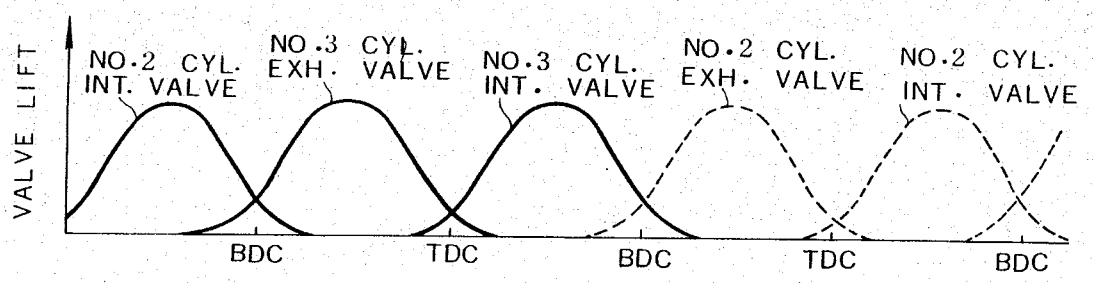
FIGS. 6(*a*), 6(*b*) and 6(*c*) are a graphical representation showing the movement of rocker arms in relation to valve lift and oil pump lift.
Figure 6B:
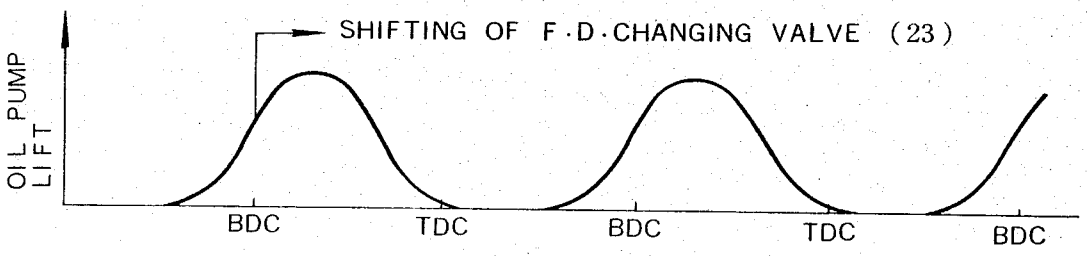
Figure 6C:
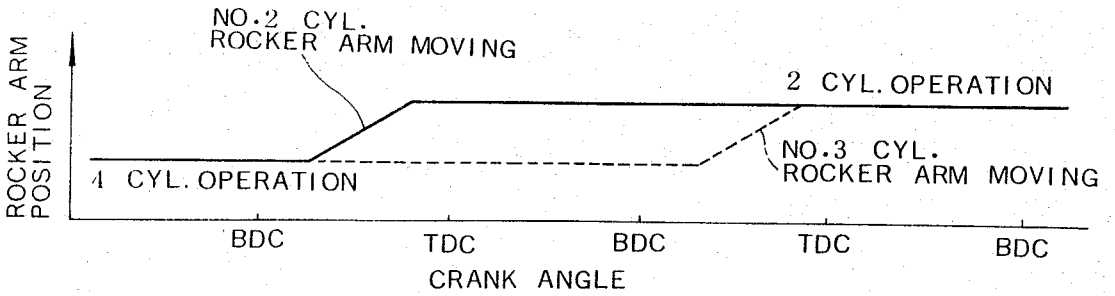

In view of the above description of the conventional valve operation changing system, reference is now made to FIGS. 5 and 6 wherein a first embodiment of a valve operation changing system of an internal combustion engine, according to the present invention is illustrated. The valve operation changing system is used in this case for an in-line four-cylinder internal combustion engine of the so-called dual-mode type wherein two cylinders (cylinder Nos. 2 and 3) are capable of being deactivated or at rest (dead). In FIG. 5, the same reference numerals as in FIGS. 1 to 3 designate the same parts and elements for the purpose of simplicity of illustration.

As usual, an intake valve 2 is provided in a cylinder head and in cooperation with a cylinder though not shown. A rocker arm 3 is rotatably mounted on a rocker shaft 4. The rocker shaft 4 is rotatably supported through brackets 5A, 5B by the cylinder head. A camshaft 6 is also rotatably supported by the cylinder head.

The camshaft 6 is formed with cams 12, 13 for the intake valve 2, and cams 12', 13' for an exhaust valve 11. These cams are disposed adjacent to each other, in which the cam 12 and the cam 13 are located side by side. The intake and exhaust valves 2, 11 are operated to open and close in a manner as shown in FIG. 4A during the activation or working of the cylinders, through the rocker arm 3 and a rocker arm 3' under the cooperation of valve springs (not shown). During the deactivation or rest, the intake valve 2 is operated to open and close in a manner as shown in FIG. 4B.

The rocker arms 3, 3' are not only swingable relative to the rocker shaft 4 but also slidable in the axial direction of the rocker shaft 4 between the brackets 5A, 5B. Accordingly, when pressurized oil is introduced into a hydraulic pressure chamber 19A defined by the rocker shaft 4, the bracket 5A, a collar 15A and the rocker arm 3, the rocker arms 3, 3' move from one state to another state, thereby changing the valve timing of the intake and exhaust valves 2, 11.

In FIG. 5, the camshaft 6 is shown to be located above the rocker shaft 4, and the intake and exhaust valves 2, 11 are shown to be located below the rocker shaft 4 in the drawing so that the camshaft 6 and the intake and exhaust valves 2, 11 are shown to be positioned approximately symmetrical with each other for reasons of convenience. Accordingly, the arrangement of them is slightly deformed relative to an actual model of the valve operation changing system in accordance with the present invention.

As shown, the cam 12 for the intake valve 2 and for cylinder activation is divided into two equal parts in a plane to which the camshaft axis is perpendicular, to form the narrower cams 12A, 12B which are the same in cam profile or contour with each other. The cam profile of the cam 13 is different from that of the narrower cams 12A, 12B. In this case, the cam profile of the cams 12A, 12B corresponds to that of the cam 6A in FIG. 1, so that the intake valve 2 operates in the manner as shown in FIG. 4A, in accordance with the cam profile of the cams 12A, 12B. The cam profile of the cam 13 corresponds to that of the cam 6B in FIG. 1, so that the intake valve 2 operates in the manner as shown in FIG. 4B, in accordance with the cam profile of the cam 13. The cam 13 is formed equal in width to the narrower cam 12A, 12B. These cams are aligned side by side in the order of the narrower cam 12A, the narrower cam 12B, and the cam 13, leaving a clearance (no numeral) between the narrower cams 12A and 12B which clearance is approximately the same in width as the cams 12A and 12B. In this connection, the follower section 14 of the rocker arm 3 is formed with two contact portions 14B, 14B which are spaced from each other and respectively contactable with the cam faces of the cams 12A and 12B. It will be understood that when the rocker arm 3 is moved toward the side of the cam 13 nearly by a distance of the width of the cam 12A, 12B, 13 in the axial direction of the rocker shaft 4 so that one of the contact portions 14B, 14B is brought into contact with the cam 13, the cam 12B becomes located between the two contact portions 14B, 14B. In this regard, a cutout portion 14A is formed between the two contact portions 14B, 14B in order that the cam 12B does not obstruct an effective contact between the cam 13 and one of the contact portions 14B. As shown, the cam 12' for the exhaust valve 11 is likewise formed to have the narrower cams 12A', 12B' which are spaced from each other. The narrower cams 12A', 12B' have a cam profile for providing the exhaust valve operation manner as shown in FIG. 4A. The cam 13' has such a cam profile that the exhaust valve remains closed as shown in FIG. 4B. The follower section 14' of a rocker arm 3' for the exhaust valve 11 is likewise formed to have two contact portions 14B', 14B' leaving a cutout portion 14A' therebetween. It will be appreciated that the cams 12A, 12B, 12A' and 12B' and the rocker arm follower sections 14, 14' are constructed and arranged such that the amount of movement of the rocker arms 3, 3' becomes nearly half that in the conventional valve operation changing system as shown in FIGS. 1 to 3.

As illustrated, the collar 15A is slidably mounted on the rocker shaft 4 and located between the rocker arm 3 and the bracket 5A, while a collar 15B is likewise mounted on the rocker shaft 4 and located between the rocker arm 3' and the bracket 5B. Additionally, a spring S is interposed between the collar 15A and the rocker arm 3 and causes the engine to operate in accordance with the cams 12, 12' at an engine starting in which hydraulic oil pressure has not yet sufficiently been raised. The spring S urges the rocker arms 3, 3' toward the side of the cams 12, 12' for cylinder activation. The reference numeral 17 denotes a spacer ring.

An oil pump 21 functions to pressurize hydraulic oil from an oil tank 29, and is so arranged that the reciprocal motion of a piston 21A of the oil pump is made by a cam 20 formed on the camshaft 6, so that the oil pump 21 discharges pressurized oil. An accumulator 22 stores or accumulates the oil from the oil pump 21 and supplies pressurized oil into the pressure chambers 19A, 19B through the flow direction changing valve 23, and into an pilot valve 24. Regard must be paid to the time duration at which the pressure within the pressure chamber 22B of the accumulator 22 again reaches a predetermined level with the oil from the oil pump 21 after the stored oil within the pressure chamber 22B is discharged. However, the time duration to obtain the predetermined pressure is, for example, about 0.5 second even during engine idling (at about 600 rpm) in the case where the discharge amount of the accumulator 22 is set to 5 cc and the discharge amount of the oil pump 21 is set to 1 cc per each engine revolution. Accordingly, it is justifiable in practice to consider that the accumulator 22 is always filled with the hydraulic oil having a pressure higher than the predetermined level.

The flow direction changing valve 23 is of the reciprocally movable four-port spool type and formed at its body section 23A with a spool hole 23B of the right cylindrical shape. A spool 23C is adapted to be disposed and slidable within the spool hole 23B. Additionally, the body section 23A of the valve 23 is provided with four annular grooves 23D which respectively communicate with a cylinder port A, a pump port P, a cylinder port B, and a tank port T as shown. The cylinder port A communicates through the oil pressure passages 18A, 4A with the hydraulic pressure chamber 19A. The cylinder port B communicates through the oil pressure passages 18B, 4B with the hydraulic pressure chamber 19B. The pump port P communicates with the pressure chamber 22B of the accumulator 22. The tank port T communicates with the oil tank 29 through a relief valve 27.

The spool 23C includes spool lands 23E in slidable contact with the inner surface of the spool hole 23B, and spool rod sections 23F. One end section of the spool 23C is formed with grooves 23G, 23H with which a stopper 26 for preventing the movement of the spool 23C is engageable. Accordingly, when the spool 23C is moved under the action of a pilot pressure from the pilot valve 24, oil passages formed under the cooperation of the annular grooves 23D and the spool rod sections 23F are changed, so that the supply of oil pressure into the hydraulic pressure chambers 19A, 19B is changed.

For example, when the pilot oil pressure acts on the right side of the spool 23C to move the spool 23C to an extreme left-hand position (in the drawing) at which the pawl 26A of the stopper 26 is engaged with the groove 23G, the pressurized oil from the accumulator 22 is supplied to the hydraulic pressure chamber 19A through the pump port P, the oil passage within the spool hole 23B, and the cylinder port A. Simultaneously, the oil in the hydraulic pressure chamber 19B is restored to the oil tank 29 through the cylinder port B, the oil passage within the spool hole 23B, and the tank port T. Conversely, when the spool 23C is in an extreme right-hand position (in the drawing) at which the stopper 26 is engaged with the groove 23H, the pressurized oil from the accumulator 22 is supplied to the hydraulic pressure chamber 19B through the pump port P, the oil passage within the spool hole 23B, and the cylinder port B. Simultaneously, the oil within the pressure chamber 19A is restored to the oil tank 29 through the cylinder port A, an oil passage within the spool hole 23B, and the tank port T.

A timing lifter 25 is provided to release the stopper 26 from the grooves 23G, 23H in timed relation to the rotation of the two cams 12, 13 for the intake valve 2 (or of the two cams 12', 13' for the exhaust valve 11). The timing lifter 25 is directly supplied (not through a check valve) with the pressurized oil whose pressure is developed by the reciprocal motion of the piston 21A which is in timed relation to the cam 20 for driving the oil pump 21. As a result, the piston 25A of the timing lifter 25 makes its simple reciprocal motion in timed relation to the cam 20. When the piston 25A is lifted (moved upwardly) against the bias of a spring 25B, the engagement of the stopper 26 with the groove 23G is released. It is to be noted that the biasing force of the spring 25B for urging the piston 25A downward is so set that the upward movement of the piston 25A is made under a pressure higher than the predetermined level for the accumulator 22. Furthermore, the cam 20 for the oil pump driving is formed such that the stopper releasing timing of this lifter 25 corresponds to the time point at which the intake valve 2 of either one cylinder (the No. 2 cylinder in this case) of the cylinders (the Nos. 2 and 3 cylinders) which are capable of being deactivated is closed.

The pilot valve 24 for controlling the flow direction changing valve 23 is arranged to be put into either one of positions P1 and P2 under the action of solenoid 24A, which is capable of being energized by an electric signal from a control circuit 30. When the solenoid 24A is operated to put the pilot valve 24 into the P1 position, the pressurized oil from the accumulator 22 is allowed to be supplied to the right side or a chamber b of the flow direction changing valve 23 so as to urge the spool 23C to the extreme left-hand position, thereby restoring the oil at the left side of the valve 23 into the oil tank 29. On the contrary, when the solenoid 24A is operated to move the pilot valve 24 into the P2 position, the pressurized oil from the accumulator 22 is allowed to be supplied to the left side or a chamber b of the flow direction changing valve 23 so as to urge the spool 23C into the extreme right-hand position, thereby restoring the oil at the right side of the valve 23 into the oil tank 29.

The control circuit 30 is adapted to receive an electric signal from an engine load sensor 31 for sensing engine load condition which sensor is in operative connection with an acceleration pedal 32, and to operate the solenoid 24A of the pilot valve 24 to put the pilot valve 24 into the P2 position when the engine is operated, for example, at a predetermined light load operating range. It will be understood that the reference numerals 28A, 28B and 28C denote check valves, respectively, and the reference numeral 27 a relief valve.

In this embodiment, the stopper 26 is engageable with either one of the annular grooves 23G, 23H of the spool 23C so as to lock the spool 23C at one of two positions. The stopper 26 is usually urged to engage with the groove 23G, 23H under the bias of a spring (not shown). The engagement of the stopper 26 with the groove 23G, 23H is released by rotating the stopper 26 in the direction opposite to the urging direction of the spring. Such rotation of the stopper 26 is made by rotating an arm 40 counterclockwise upon engagement with a projectable rod 25C of the timing lifter 25. It is to be noted that the engagement of the arm 40 and the timing lifter rod 25C is made only when an electromagnetic actuator 41 is in a state in which a movable rod 41*a* moves leftward in the drawing. As seen from drawing, the leftward movement of the actuator rod 41*a* causes the arm 40 to be engaged with the timing lifter projectable rod 25C. The projectable rod 25C of the timing lifter 25 is connected to the piston 25A which directly receives the oil pressure from the oil pump 21, so that the rod 25C makes its reciprocal motion in timed relation to the reciprocal motion of the oil pump piston 21A or the rotation of the cams 12, 12'.

The electromagnetic actuator 41 is arranged to be energized a predetermined time period to move the rod 41*a* leftward in the drawing when the engine operation is changed from a predetermined high engine load range to a predetermined low engine load range, or from the predetermined low engine load range to the predetermined high engine load range. This energization of the electromagnetic actuator 41 is accomplished by the control circuit 30 which receives the signal from the engine load or acceleration sensor 31 which senses the depression amount of the acceleration pedal 32.

Additionally, in this embodiment, two flow control valves 33 and 34 are disposed respectively in the two oil passages 18B, 18B through which the port B of the flow direction changing valve 23 is communicable with the two hydraulic pressure chambers 19B, 19B. Each flow control valve 33, 34 is arranged to open to allow communication between the port B and the hydraulic pressure chamber 19B through the oil passage 18B when the cams of the camshaft 6 are at a predetermined position or angle. The flow control valve 33, 34 includes a valve member 35 which is slidably disposed within a bore (no numeral) of a valve housing 36. The valve member 35 is arranged to open and close the oil passage 18B opened to the valve housing bore. The valve member 35 is always urged in the direction to close the oil passage 18B by a spring 37, and is connected to a tappet like rod 38 which drives the valve member in the axial direction. The tip end of rod 38 is projected outside of the valve housing bore and in contact with a rotating cam 39A, 39B which is rotatable in synchronism with the camshaft 6 so that the cam 39A, 39B makes one rotation per each rotation of the camshaft 6. Accordingly, the flow control valve 33, 34 opens and closes in accordance with the cam profile or contour of the rotating cam 39A, 39B. It is to be noted that the cam profile of the cam 39A, 39B is so shaped that the flow control valve 33, 34 opens to allow oil pressure supply through the oil passage 18B during a time period other than the time periods during which the intake and exhaust valves in connection with the valve 33, 34 lift or open, i.e., that the valve 33, 34 opens during the compression or expansion stroke of the corresponding cylinder. Thus, oil pressure is introduced through the oil passage 18B to the hydraulic pressure chamber 19B during the time period other than the time periods of valve lifts by the cams 12, 12′ when the valve operation changing of the intake and exhaust valves is carried out.

The manner of operation of the thus arranged valve operation changing system will now be discussed.

During the engine operation in which all the cylinders are working, the intake and exhaust valves 2, 11 open and close in the manner as shown in FIG. 4A in accordance with the cams 12, 12′. Simultaneously, the reciprocal movement of the oil pump piston 21A is made in accordance with the cam 20 for oil pump driving, thus supplying under pressure the hydraulic oil from the oil tank 29 to the accumulator pressure chamber 22B in which the oil pressure is raised to the predetermined level. The oil having the thus raised pressure reaches both the pump port P of the direction changing valve 23 and the pilot valve 24.

In this state, since the pilot valve 24 is in the P1 position, the pilot oil pressure from the pilot valve 24 is applied to the right side or the chamber b of the flow direction changing valve so as to urge the spool 23C to the extreme left-hand position, so that the stopper 26 engages with the groove 23G as shown in FIG. 5. In this state, the oil supplied to the pump port P is supplied to the hydraulic pressure chamber 19A through the oil passage within the spool hole 23B, the cylinder port A, and the oil pressure passages 18A, 4A, so that the rocker arms 3, 3′ are urged to be located on the cams 12, 12′ for cylinder working. At this time, the hydraulic pressure chamber 19B communicates with the oil tank 29 through the oil pressure passages 4B, 18B, the cylinder port B, the oil passage within the spool hole 23B, and the tank port T.

When the control circuit 30 detects that the engine is operated at the predetermined light load operating range, in accordance with the signal from the load sensor 31 in operative connection with the acceleration pedal 32, the solenoid 24A of the pilot valve 24 is operated to change the pilot valve 24 from the P1 position to the P2 position. Accordingly, the pilot oil pressure from the pilot valve 24 acts on the left side or the chamber a of the flow direction changing valve 23 to urge the spool 23C rightward. At this time, the electromagnetic actuator 41 is energized the predetermined time period to move the arm 40 leftward in FIG. 5. Accordingly, the rod 25C of the timing lifter 25 and the arm 40 are put into the state where they can be engaged with each other. Now, the rod 25C of the timing lifter 25 makes its reciprocal motion in timed relation to the lift of the cams 12, 12′, and arranged to be projected so as to rotate the stopper 26 through the arm 40, thus releasing the engagement of the stopper 26 with the spool 23C in the vicinity of bottom dead center. Such engagement release at the predetermined timing is accomplished by suitably setting the phase of the cam 20 for driving the oil pump 21. When the stopper 26 is released, the spool 23C of the flow direction changing valve 23 is shifted rightward in FIG. 5 and locked as it is so that the stopper 26 engages with the groove 23H of the spool 23C. This is because the lift of the timing lifter 25 is not made until the accumulator 22 is again filled with the oil, in which the electromagnetic actuator 41 is again deenergized.

Under the thus shifted condition of the flow direction changing valve 23, the oil pressure from the accumulator 22 is supplied to the flow control valves 33 and 34 while the oil pressure within the hydraulic pressure chambers 19A, 19A is released through the flow direction changing valve 23 to the side of the oil tank 29. At this time, when the corresponding cylinder enters the compression or expansion stroke, the flow control valves 33, 34 are opened under the action of the rotating cams 39A, 39B thereby to introduce the oil pressure to the hydraulic pressure chambers 19B, 19B.

Thus, the rocker arms 3, 3′ are smoothly moved to the side of the cams 13, 13′ without being raised by the cams 12, 12′ thereby changing the manner of valve operation of the intake and exhaust valves 2, 11 as illustrated in FIG. 6.

In order to restore the rocker arms 3, 3′ to the side of the cams 12, 12′, the hydraulic pressure chambers 19A, 19A are supplied with oil pressure through the flow direction changing valve 23 while the previously supplied pressurized oil has been confined within the hydraulic pressure chambers 19B until the flow control valves 33, 34 are opened. The thus confined pressurized oil is released to the side of the oil tank 29 at the compression or expansion stroke of the corresponding cylinder in which the flow control valves 33, 34 are opened. Accordingly, the rocker arms 3, 3′ are smoothly moved back onto the cams 12, 12′ without overlapping the cam lift of the cams 12, 12′.

It will be understood that the axial movement of the rocker arms 3, 3′ never occurs during lift of the cams 12, 12′, so that the rocker arms 3, 3′ are effectively prevented from contacting with the cam lobe of cams 12, 12′ during axial movement thereof, thereby avoiding damage and breakage of the rocker arms 3, 3′ and the cams 12, 12′ while improving the durability of the valve operation changing system. Furthermore, by virtue of using the flow control valves 33, 34, the shifting timing of the flow direction changing valve 23 can be suitably set thereby to facilitate the control of the valve operation control system. Moreover, since there is no possibility of damaging rocker arms 3, 3′ and the cams 12, 12′, the moving speed of the rocker arms 3, 3′ can be further increased, for example, by raising oil pressure, which makes possible to precisely carry out the operation changing of the intake and exhaust valves 2, 11 even during a high engine speed operation. In addition, it will be appreciated that the principle of the embodiment of FIG. 5 is easily applicable to cases where the rocker arms 3, 3′ are individually moved by using the flow control valve 33, 34 corresponding to each rocker arm 3, 3′.

Figure 7:
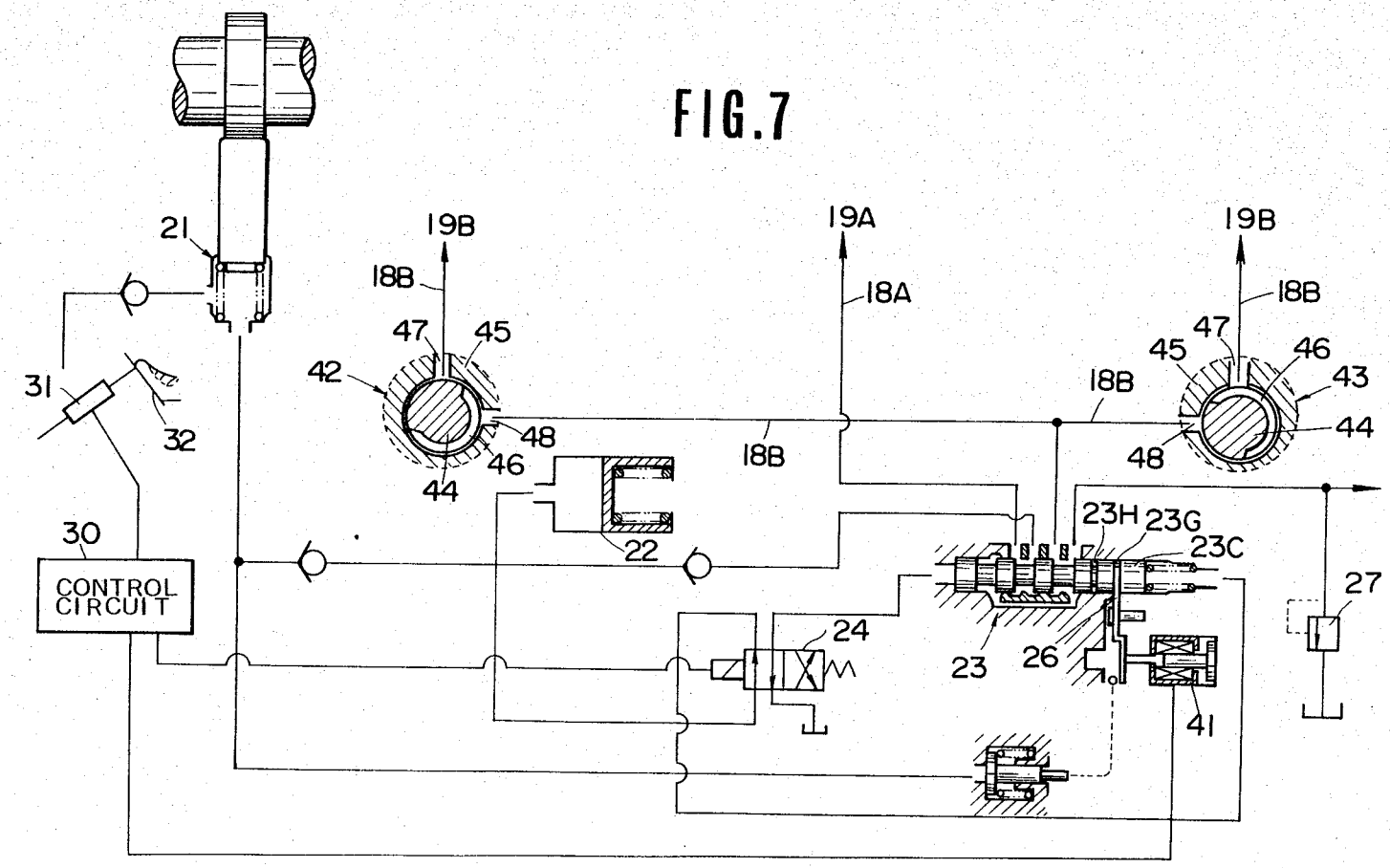
FIG. 7 is a diagrammatic illustration of an essential part of a modified example of the system of FIG. 5.

FIG. 7 shows a modified example of the embodiment of FIG. 5, in which the flow control valves 42, 43 different in type from those in FIG. 5 embodiment are disposed respectively in the oil passages 18B, 18B. The flow control valve 42, 43 includes a rotatable spool 44 rotatably disposed in the bore of a valve housing 45.

The spool 44 is formed at its peripheral surface with a groove 46 which elongates in a distance of about half the outer periphery along the outer periphery of the spool. Additionally, the valve housing 45 is formed with first and second ports 47, 48 which are openable to the groove 46 of the spool 44 so as to be communicated with each other. The first port 47 is communicated with the hydraulic pressure chamber 19B while the second hole 48 is communicated with the port B of the flow direction changing valve 23. Accordingly, when the spool 44 is rotated to a position where the ports 47 and 48 are opened to the groove 46, oil pressure from the flow direction changing valve 23 is introduced into the hydraulic pressure chambers 19B, 19B. The spool 44 is connected to the camshaft 6 in a manner to be rotatable in synchronism with the camshaft so that the spool 44 makes one rotation per one rotation of the camshaft. The locational relationship between the groove 46 and the ports 47, 48 is so determined that the ports 47, 48 are communicated with each other to cause the flow control valve 42, 43 to open during the compression or expansion stroke of the corresponding cylinder. The thus arranged flow control valve 42, 43 is simpler in construction and reduces pressure variation during opening and closing thereof.

Figure 8:
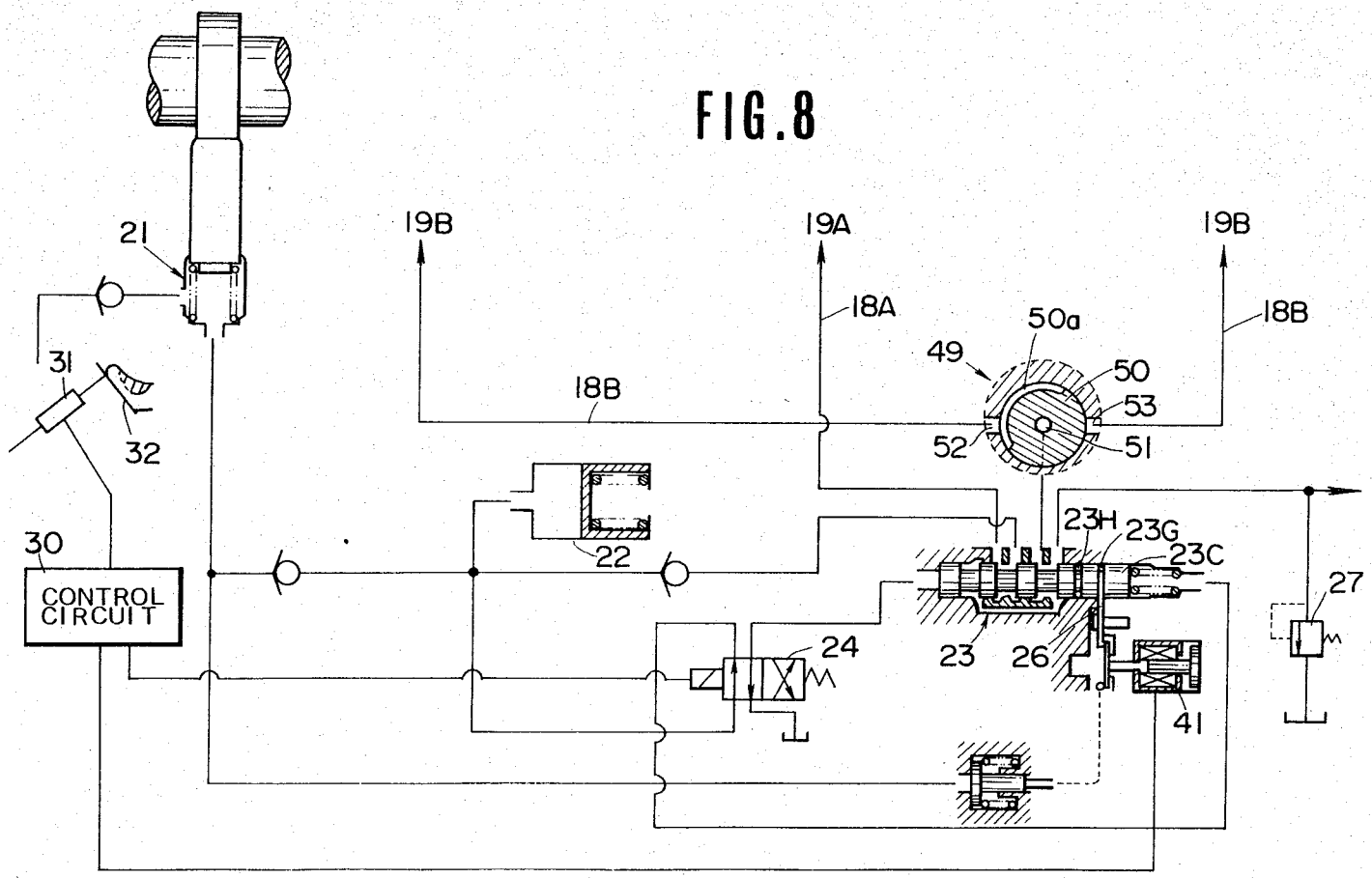
FIG. 8 is a diagrammatic illustration similar to FIG. 7 but showing a modified example of the system of FIG. 7.

The flow control valves 42, 43 may be replaced with a flow control valve 49 shown in FIG. 8. The flow control valve 49 includes a spool 50 which is formed at its central section with an oil passage 51 communicated with the port B of the flow direction changing valve 23 and also with a groove 50*a* formed at the peripheral surface of the spool 50. The spool oil passage 51 is suitably communicable through the groove 50*a* with first and second ports 52 and/or 53 in accordance with the rotation of the spool 50. The first and second ports 52 and 53 are respectively communicated with the hydraulic pressure chambers 19B, 19B. It will be understood that the spool 50 is rotatable in synchronism with the camshaft 6.

Figure 9:
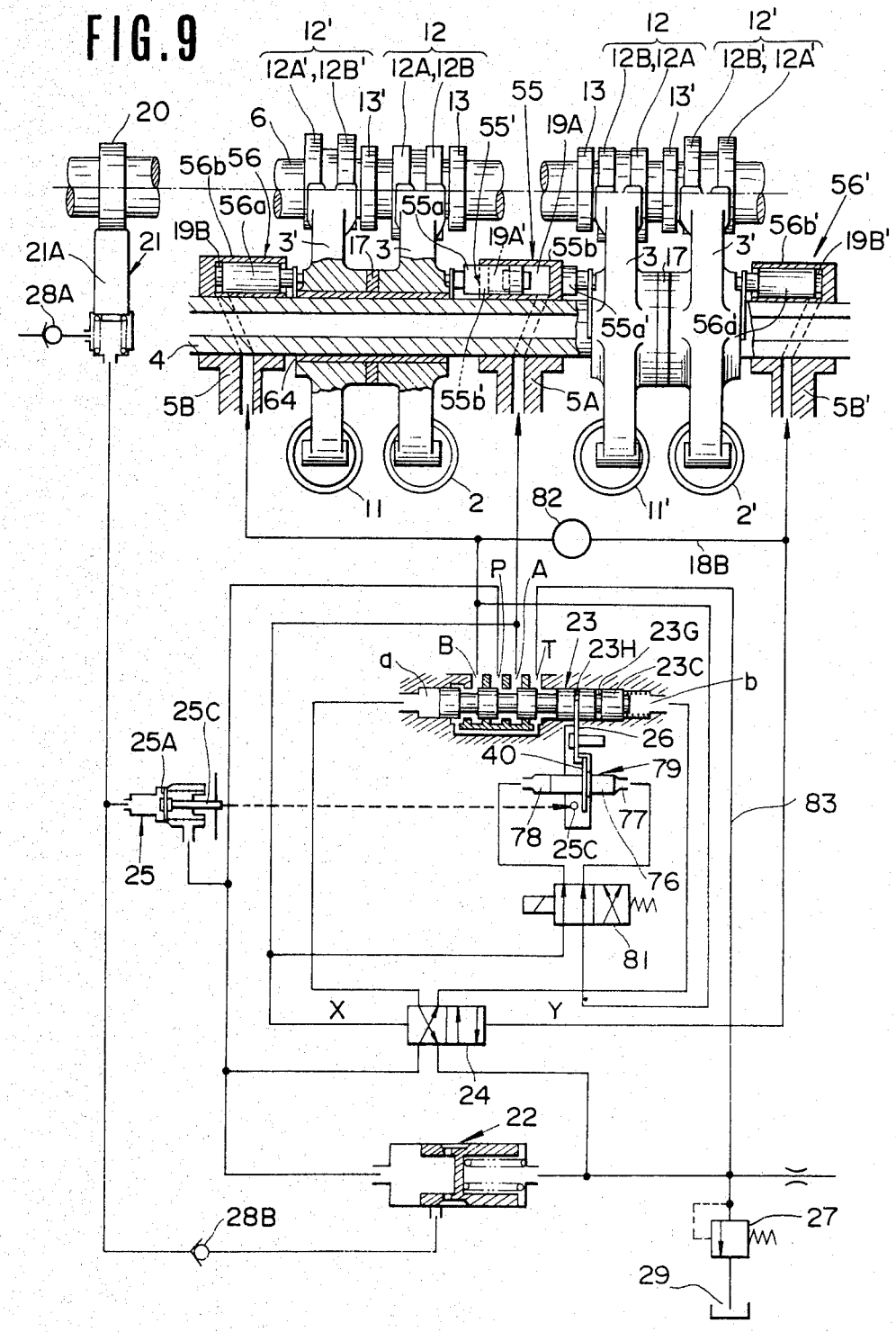
FIG. 9 is a diagrammatic illustration of a further embodiment of the valve operation changing system in accordance with the present invention.
Figure 10:
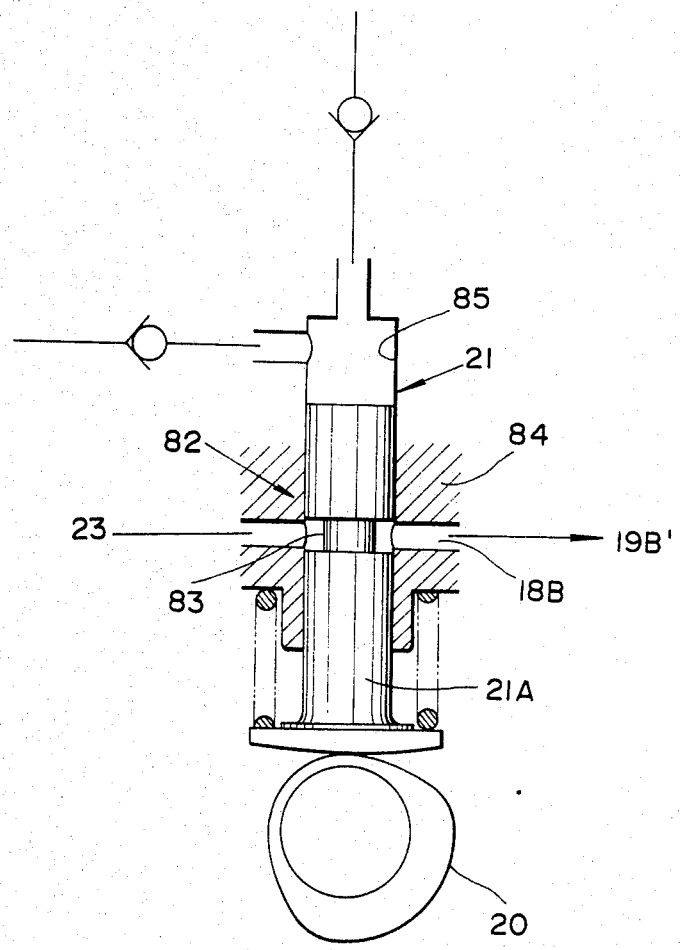
FIG. 10 is a schematic view of a flow control valve used in the system of FIG. 9.

FIGS. 9 and 10 illustrate a further embodiment of the valve operation changing system in accordance with the present invention.

In this embodiment, the bracket 5A is provided with two actuators 55, 55' each of which includes a piston 55*a*, 55*a'* which is movably disposed within a cylinder 55*b*, 55*b'* defining the hydraulic pressure chamber 19A, 19A'. The brackets 5B and 5B' are provided respectively with hydraulic actuators 56, 56' each of which includes a piston 56*a*, 56*a'* which is movably disposed within a cylinder 56*b*, 56*b'* defining therein the hydraulic pressure chamber 19B, 19B'. The pistons 55*a*, 56*a* of the actuators 55, 56 are connected to the opposite end sections of a sleeve 64 through which the rocker arms 3, 3' (for the intake and exhaust valves 2, 11) are rotatably mounted on the rocker shaft 4. The pistons 55*a'*, 56*a'* of the actuators 55', 56' are connected to the opposite end sections of a sleeve (not shown) through which the rocker arms 3, 3' (for the intake and exhaust valves 2', 11') are rotatably mounted on the rocker shaft 4. In this embodiment, the intake and exhaust valves 2, 11 are of a No. 2 cylinder while the intake and exhaust valves 2', 11' are of a No. 3 cylinder. Additionally, the two rocker arms 3, 3' are movable in the axial direction together with the sleeve 64. It will be understood that the pistons 55*a*, 56*a*, 55*a'*, 56*a'* move so as to project from the corresponding cylinders 55*b*, 56*b*, 55*b'*, 56*b'*, respectively, thus selectively locating the rocker arm 3, (3') onto one of the cam 12 (12') for cylinder activation or working and the cam 13 (13') for cylinder deactivation or rest. Though not shown, a spring may be interposed between the bracket 5A and the rocker arm 3 to urge the rocker arms to be located on the cams 12, 12' for causing all the cylinder to work even at engine starting where the oil pressure has not yet been raised to a predetermined level.

As shown, the oil pump 21 includes the piston 21A which is driven by the cam 20 formed on the camshaft 6. The oil pump 21 functions to pressurize hydraulic oil sucked from the oil gallery via the check valve 28A. The discharge side of the oil pump 21 is fluidly connected to the timing lifter 25, and via the check valve 28B to the accumulator 22 which is in turn fluidly connected to the port P of the flow direction changing valve 23. The flow direction changing valve 23 is so arranged that either one of the opposite side chambers a and b is supplied with signal hydraulic pressures from the pilot valve 24 in order to shift the spool 23C to the extreme left-hand or right-hand position in the drawing so that the port P is fluidly connected to either one of the ports A and B. The port A is fluidly connected to the hydraulic pressure chamber 19A, 19A' of the hydraulic actuator 55, 55', while the port B is fluidly connected to the hydraulic pressure chamber 19B, 19B' of the hydraulic actuator 56, 56'. Additionally, when one of the ports A and B is in communication with the port P, the other becomes in communication with the port T. The port T is fluidly connected to the oil tank side through an orifice (no numeral) and also to the oil tank 29 through the relief valve 27.

The pilot valve 24 is arranged to receive the pressure X developed between the port A and the hydraulic pressure chamber 19A, 19A' and the pressure Y developed between the port B and the hydraulic pressure chamber 19B, 19B', and is shifted in accordance with the difference between the pressures X and Y so as to supply either one of the chambers a and b of the flow direction changing valve with oil pressure from the accumulator 22, the other chamber being fluidly connected to the oil tank 29. The pilot valve 24 is shifted in such a manner as to shift the flow direction changing valve 23 to the initial position by the oil pressures X, Y which have varied due to the shifting of the flow direction changing valve 23. The flow direction changing valve spool 23C is formed side by side in the axial direction with the grooves 23G, 23H with which the stopper 26 is engageable to lock the spool 23C at the extreme left-hand or right-hand position. The stopper 26 is biased in the direction to engage the groove 23G, 23H by a spring (not shown).

The timing lifter 25 functions to release the engagement of the stopper 26, and so arranged that its piston 25A directly receives the oil pressure from the oil pump 21 to reciprocally move the output rod 25C in timed relation to the lift of the oil pump piston 21A, i.e., to the lift of the cams 12, 13, 12', 13'. The output rod 25C of the timing lifter 25 is engageable with one end of the lever 40 the other end of which is engageable with the stopper 26. Accordingly, the stopper 26 is released from the spool groove 23H, 23G when the output rod 25C causes the stopper 26 to rotate through the arm or lever 40. It is to be noted that the lever 40 is axially movable together with a shaft 76 on which the lever 40 is rotatably mounted, so that the output rod 25C does not engage with the the lever 40 when the lever 40 has been moved rightward as shown in FIG. 9, while engages with the lever 40 to release the stopper from the spool groove only when the lever 20 is moved leftward in FIG. 9.

A hydraulic clutch 79 includes the shaft 76 which forms a piston of a double-acting cylinder in which two hydraulic chambers 77, 78 are formed on the opposite sides relative to the piston 76. In other words, the opposite ends of the shaft or piston 76 define the hydraulic chambers 77, 78, respectively. Thus, the shaft 76 forms part of the hydraulic clutch 79. The hydraulic chambers 77, 78 are suppliable with the oil pressures X, Y through an electromagnetic flow direction shifting valve 81. The flow direction shifting valve 81 is so arranged as to be deenergized by a control circuit (not shown) in response to a change in engine operating condition such as an engine load lowering. Accordingly, in a low engine load operating condition, the flow direction shifting valve 81 is deenergized to be so shifted that the oil pressure X is introduced into the hydraulic pressure chamber 77 while the oil pressure Y is introduced into the hydraulic pressure chamber 78.

In this embodiment, the timing lifter 25 is arranged to project its output rod 25*c* at the terminal period of lift of the No. 2 cylinder intake valve 2 so as to accomplish oil pressure supply change between the hydraulic pressure chambers 19A and 19B and between the hydraulic pressure chambers 19A′ and 19B′ at the timing of the termination of lift of the No. 2 cylinder intake valve 2.

Figure 11A:
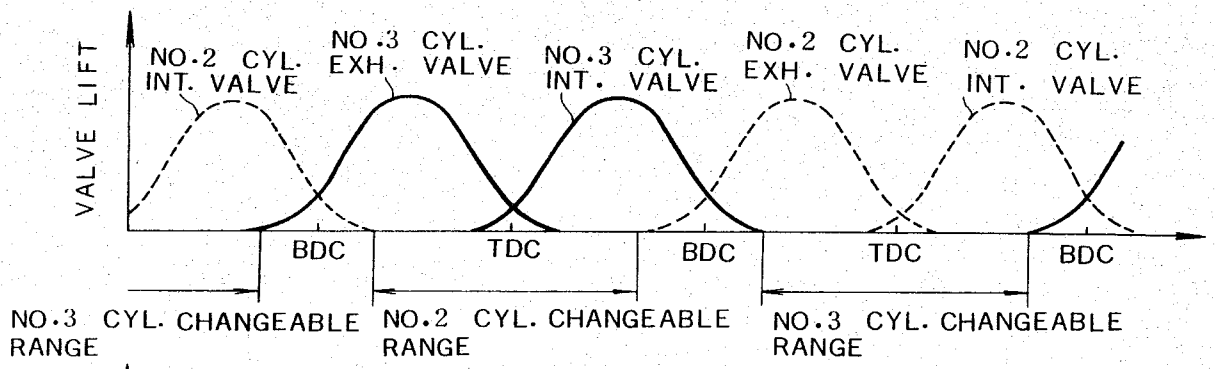
FIGS. 11(*a*) and 11(*b*) and 11(*c*) are a graphical representation showing the movement of rocker arms in relation to valve lift and oil pump lift.
Figure 11B:
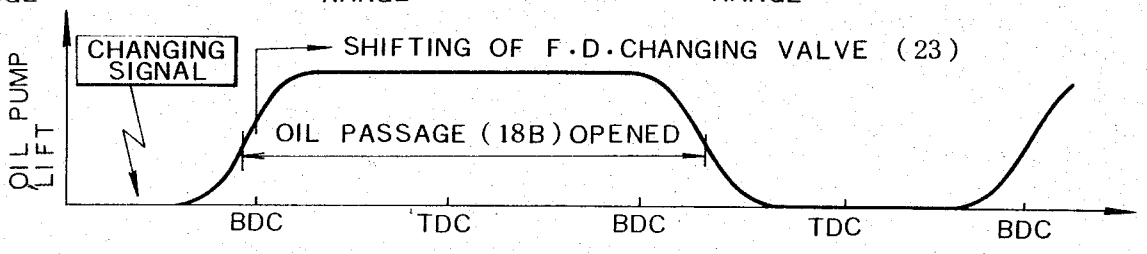
Figure 11C:
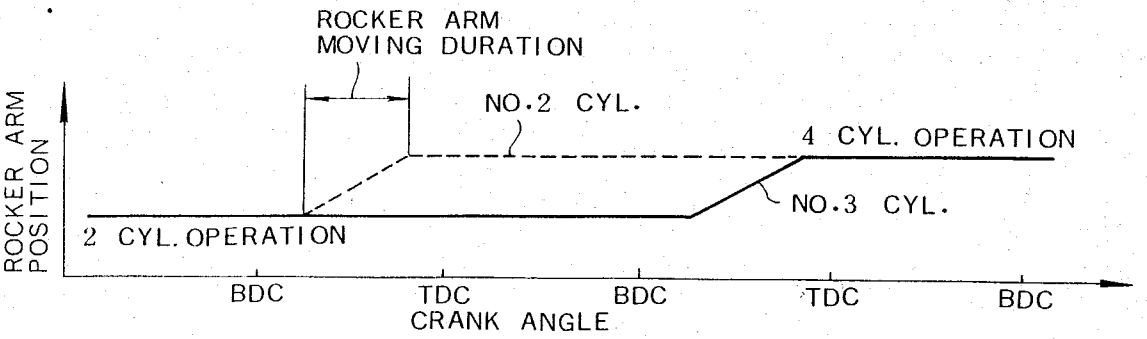

Additionally, a flow control valve 82 is disposed in the oil passage 18B for connecting the port B of the flow direction changing valve 23 and the hydraulic pressure chamber 19B′ of the actuator 56′. As shown in detail in FIG. 10, the flow control valve 82 includes a peripheral groove 83 formed along the peripheral surface of the piston 21A of the oil pump 21 which is driven by the cam 20 formed on the camshaft 6. The groove 83 is communicable with the oil passage 18B so that the port B of the flow direction changing valve 23 is communicated with the hydraulic pressure chamber 19B′ of the actuator 56′. In this connection, the oil passage 18B is formed in the cylinder head 84 and via the piston bore 85 in which the piston 21A is reciprocally movably disposed. Accordingly, the communication between the flow direction changing valve port B and the hydraulic pressure chamber 19B′ is blocked when the piston 21A ascends in FIG. 10, i.e., during oil discharge action of the oil pump 21, while the communication is established when the piston 21A is at a lower position. In this connection, the lift characteristics of the oil pump driving cam 20 is set as follows: The initiation timing of lift is restricted within a time period in order to release the stopper 26 at an appropriate timing. Besides, the flow control valve 82 is maintained under its closed state to block the communication between the port B and the hydraulic pressure chamber 19B′ during a time period before a timing at which the valve operation changing (the axial movement of the rocker arms) is suitable for the No. 3 cylinder. In order to satisfy the above-mentioned requirements, the lift characteristics of the cam 20 is set as shown in FIG. 11 in which the lift of the cam 20 is initiated at the terminal period of lift of the No. 2 cylinder intake valve 2 and terminated at the terminal period of lift of the No. 3 cylinder intake valve 2′. During this lift of the cam 20 in which the cam lift is above a predetermined level, the peripheral groove 83 is not in communication with the oil passage 18B so as to block the oil passage 18B.

In operation of the FIG. 9 embodiment, when all the cylinders are working in which the flow direction changing valve 23 is shifted as shown in FIG. 9, oil pressure is introduced into the hydraulic pressure chamber 19A of the hydraulic actuator 55, 55′ and therefore the rocker arms 3, 3′ are driven by the cams 12, 12′, respectively, for working or activating the cylinders 2, 11, 2′, 11′. At this time, since the oil pressure X is higher than the other of the pressures acting on the pilot valve 24, the pilot valve 24 has been shifted in the state shown in FIG. 9, thereby introducing the oil pressure into the chamber b of the flow direction changing valve 23 Consequently, the flow direction changing valve 23 is in a shiftable condition; however, the spool 23C is locked by the stopper 26 thus preventing the shifting of the flow direction changing valve 23.

At this time, the electromagnetic flow direction shifting valve 81 has been shifted in the state shown in FIG. 9, so that the higher oil pressure X is introduced into the hydraulic pressure chamber 78 of the hydraulic clutch 79. Accordingly, the lever 40 has been moved rightward together with the shaft 76 as shown in FIG. 9, in which the output rod 25C of the timing lifter 25 is not brought into engagement with the the lever 40 and therefore the stopper 26 is not released even upon the reciprocal movement of the timing lifter output rod 25C.

From this state, when the control circuit detects an engine operating condition change or a reduction in engine load, the electromagnetic flow direction shifting valve 81 is deenergized to be shifted into the state opposite to that shown in FIG. 9. Consequently, the higher oil pressure X is introduced into the chamber 77 of the hydraulic clutch 79 so as to push the shaft 76 leftward in the drawing together with the lever 40. This establishes the connection of the rod 25C of the timing lifter 25 with the stopper 26. Under this condition, when the timing lifter rod 25C is projected by the oil pressure from the oil pump 21, the stopper 26 is released from the groove 23H through the lever 40 and therefore the flow direction changing valve spool 23C moves leftward in the drawing, so that the magnitude of the oil pressures X and Y are reversed.

Immediately before this reversal of the oil pressure magnitude, the flow control valve 82 has caused to block the oil passage 18B, maintaining thereafter this state, and then causes to open the oil passage 18B at the terminal period of lift of the No. 3 cylinder intake valve 2′ in which the oil passage 18B is brought into communication with the peripheral groove 83 of the oil pump piston 21A under the lifting of the cam 20. Accordingly, higher oil pressure from the accumulator 22 is supplied through the flow direction changing valve 23 to the hydraulic pressure chamber 19B′ of the actuator 56′, so that the rocker arms 3, 3′ for the No. 3 cylinder move leftward in the drawing by the projection of the piston 56*a*′ of the actuator 56′. As a result, the rocker arms 3, 3′ are put respectively onto the cams 13, 13′ for cylinder deactivation, so that the No. 3 cylinder is changed from its working state to its rest state. On the contrary, in case where the Nos. 2 and 3 cylinders are put from their rest state to working state, such a change is accomplished at the first time after the oil passage 18B (through which oil pressure is released) is opened to allow oil flow so that the hydraulic pressure chamber 19A′ of the actuator 55′ is supplied with the high pressure oil from the accumulator 22.

Thus, since the oil pressures to be supplied to the hydraulic actuators 55′ and 56′ are not changed until the operational cycle of the No. 3 cylinder reaches the timing suitable for the operation change between the working state and the rest state, the rocker arms 3, 3' for the No. 3 cylinder are prevented from its rubbing contact with the cams 12, 12' with a higher friction during the operation change from the working state to the rest state, thereby avoiding the breakage of the rocker arms 3, 3' and/or cams 12, 12'. Besides, the rocker arms 3, 3' are prevented from the rubbing contact with the cams 12, 12' during the operation change from the rest state to the working state, thereby suppressing the sliding wear of the rocker arms 3, 3' and/or the cams 12, 12'. It will be understood that, regarding to the No. 3 cylinder, the operation change between the working state and the rest state can be accomplished at appropriate timings.

As shown, in the embodiment of FIG. 9, an oil passage (indicated by the reference numeral 83) is provided in parallel with the oil passage 18B to fluidly connect the port B of the flow direction changing valve 23 with the flow direction shifting valve 81. This prevents the operation changing of the hydraulic clutch 79 from being affected by the flow control valve 82.

While the flow control valve 82 has been shown and described as being of the tappet type wherein the piston 21A is directly driven by the cam 20 mounted on the camshaft 6, it will be appreciated that it may be of the type wherein a piston is driven by a special rocker arm in which a suitable selection of the lever ratio of the special rocker arm facilitates to increase the lift amount of the piston thereby improving the control accuracy of the flow control valve 82.

Additionally, the flow control valve 82 of the FIG. 9 embodiment is constituted as a part of the oil pump 21, and therefore the valve operation changing system of the present invention can be simplified contributing to production cost reduction. It will be understood that the flow control valve 82 may be formed separately and independently from the oil pump 21 in which a peripheral groove is formed on the peripheral surface of a piston other than the oil pump piston 21A.

While the cam 12 (12') including narrower cams 12A, 12B (12A', 12B'), and the cam 13 (13') have been shown and described as being used for activating and for deactivating cylinder, respectively, in the system of the embodiments of FIGS. 5, 7, 8 and 9, it will be understood that the cam 12 (12') and the cam 13 (13') may be, for example, used for a high engine speed operation and for a low engine speed operation, respectively. In accordance with the cam for the high engine speed operation, the valve overlap of intake and exhaust valves will be increased thereby to improve the charging efficiency of intake air at a high engine speed operating range. In accordance with the cam for the low engine speed operation, the valve overlap will be decreased to prevent exhaust gas backward flow to the cylinder in the state where a throttle valve opening degree is smaller, thereby improving the charging efficiency of intake air even at a low engine speed operating range.

It will be clearly understood from the above, that such a cam arrangement shown in FIGS. 5, 7, 8 and 9 is applicable to a variety of engines other than dual-mode engines in which some of cylinders are deactivated in accordance with engine operating conditions.

Although the stopper 26 has been shown and described as restricting the operation of the flow direction changing valve in the above-discussed embodiments, it will be appreciated that the stopper or corresponding means may be arranged to directly restrict the movement of the rocker arms or to directly restrict the operation of the actuator having the hydraulic pressure chambers 19A, 19B, 19A', 19B'.

While the embodiments of the present invention, as herein disclosed, constitute preferred forms, it is to be understood that other forms might be adapted.

What is claimed is:

1. A valve operation changing system of an internal combustion engine, comprising:

first and second cams formed on a camshaft and different in cam profile from each other;

a rocker arm mounted on a rocker shaft and swingable around the rocker shaft to operate an engine valve upon engagement with said cams, said rocker arm being axially movable to engage with said first cam when said rocker arm is in a first position and to engage with said second cam when said rocker arm is in a second position; and means for selectively moving said rocker arm into one of said first and second positions in accordance with an engine operating condition, said moving means including:

means defining first and second hydraulic pressure chambers which are fluidly connectable with an oil pressure source to be supplied with pressurized oil, said first hydraulic pressure chamber causing said rocker arm to move into the first position when fluidly connected with the oil pressure source, said second hydraulic pressure chamber causing said rocker arm to move into the second position when fluidly connected with the oil pressure source;

a flow direction changing valve through which said first and second hydraulic pressure chambers are communicable with the oil pressure source, said flow direction changing valve selectively taking one of a first state to fluidly connect said first hydraulic pressure chamber with the oil pressure source and a second state to fluidly connect said second hydraulic pressure chamber with the oil pressure source; and valve means fluidly interposed between said flow direction changing valve and said second hydraulic pressure chamber, said valve means being openable to fluidly connect said flow direction changing valve with said second hydraulic pressure chamber in accordance with the rotational position of said cams.

2. A valve operation changing system as claimed in claim 1, wherein said moving means comprises means for causing said valve means to open during a time period other than a time period in which said engine valve lifts.

3. A valve operation changing system as claimed in claim 2, wherein said causing means causes said valve means to open at one of a compression stroke and an expansion stroke of a corresponding cylinder of the engine.

4. A valve operation changing system as claimed in claim 2, wherein said valve means includes a flow control valve disposed in an oil passage fluidly connecting said flow direction changing valve with said second hydraulic pressure chamber, said flow control valve including a valve member disposed in a valve housing and movable to open and block said oil passage in synchronism with the rotation of said camshaft.

5. A valve operation changing system as claimed in claim 4, wherein said valve member is axially movable in said valve housing, wherein said causing means includes a cam member for driving said valve member, rotatable in synchronism with the rotation of said camshaft.

6. A valve operation changing system as claimed in claim 4, wherein said valve member is a spool member rotatable within the bore of said valve housing which is disposed in said oil passage, said spool member being formed at its peripheral surface with a groove with which said oil passage is communicable so as to open said oil passage, said spool member being rotatable in synchronism with the rotation of said camshaft.

7. A valve operation changing system as claimed in claim 6, wherein said spool member is formed with an axial oil passage communicable with said flow direction changing valve and with said groove.

8. A valve operation changing system as claimed in claim 2, further comprising stopper means for restricting the movement of said rocker arm, and means for releasing said rocker arm from the restriction action of said stopper means in timed relation to the rotation of said first and second cams when actuated.

9. A valve operation changing system as claimed in claim 2, wherein said oil pressure source includes an oil pump driven in timed relation to the revolution of the engine to pressurize the hydraulic oil.

10. A valve operation changing system as claimed in claim 9, wherein said oil pump has a pump piston which is reciprocally movable in timed relation to the engine revolution to provide oil pressure.

11. A valve operation changing system as claimed in claim 10, wherein said valve means includes a peripheral groove formed at the peripheral surface of said pump piston, said pump piston being slidably disposed in a piston bore, said piston bore being disposed in an oil passage connecting said flow direction changing valve and said second hydraulic pressure chamber, said peripheral groove being movable into and out of said oil passage so as to cause said oil passage to open and close.

12. A valve operation changing system as claimed in claim 6, wherein said peripheral groove is so formed as to be communicable with said oil passage at the terminal period of lift of an intake valve of a corresponding cylinder of the engine.

13. A valve operation changing system claimed in claim 2, further comprising an oil accumulator fluidly interposed between said oil pressure sources and said flow direction changing valve to accumulate the pressurized oil from said oil pressure source.

14. A valve operation changing system as claimed in claim 13, further comprising means for selectively putting said flow direction changing valve into one of the first and second states in accordance with the engine operating condition.

15. A valve operation changing system as claimed in claim 8, wherein said stopper means is arranged to restrict the operation of said flow direction changing valve; and said releasing means is arranged to release said flow direction changing valve from the restriction action of said stopper means in timed relation to the rotation of said first and second cams when actuated.

16. A valve operation changing system as claimed in claim 8, wherein said moving means includes an actuator for moving said rocker arm, said first and second hydraulic pressure chambers forming part of said actuator, and said stopper means inhibits the operation of said actuator.

17. A valve operation changing system as claimed in claim 15, wherein said flow direction changing valve includes a movable valve member which is locatable in first and second positions corresponding respectively to the first and second states of said flow direction changing valve.

18. A valve operation changing system as claimed in claim 17, further comprising means for selectively putting said flow direction changing valve into one of the first and second states in accordance with an engine operating condition, wherein said flow direction changing valve putting means includes a pilot valve which takes first and second states for causing said flow direction changing valve movable valve member to be located in the first and second positions, respectively.

19. A valve operation changing system as claimed in claim 18, wherein said oil pressure source comprises an oil pump which includes a piston which is reciprocally movable in timed relation to a drive cam formed on said camshaft on which said first and second cams are formed, the reciprocal motion of said piston presurizing the oil.

20. A valve operation changing system as claimed in claim 19, wherein said stopper means includes a stopper member which is engageable with said movable valve member of said flow direction changing valve to stop the movement of said movable valve member.

21. A valve operation changing system as claimed in claim 20, wherein said releasing means includes a timing lifter directly fluidly connected to said oil pump and operated in timed relation to the rotation of said drive cam, said timing lifter being arranged to release the engagement of said stopper member with said valve member of said flow direction changing valve, upon connection with said stopper member.

22. A valve operation changing system as claimed in claim 21, further comprising means for moving said valve member of said flow direction changing valve by the pressure of the oil from said oil pressure source through said pilot valve.

23. A valve operation changing system as claimed in claim 22, further comprising means for selectively putting said pilot valve into one of the first and second states in accordance with a difference between pressures in connection with first and second hydraulic pressure chambers, respectively.

24. A valve operation changing system as claimed in claim 23, wherein the connection of said timing lifter and said stopper member is capable of being interrupted, said system further comprising means for providing the connection of said timing lifter and said stopper member only in response to a predetermined engine operating condition in which the shifting of said rocker arm between the first and second positions is necessary.

25. A valve operation changing system as claimed in claim 24, wherein said providing means includes clutch means operatively interposed between said timing lifter and said stopper member to establish the connection between said timing lifter and said stopper member when engaged, and control means for causing said clutch means to be engaged in response to the predetermined engine operating condition.

26. A valve operation changing system as claimed in claim 25, wherein said clutch means includes a hydraulically operated clutch operated to be engaged or disengaged in accordance with a pressure in connection with said first and second hydraulic pressure chambers.

27. A valve operation changing system as claimed in claim 26, wherein said control means includes valve means for controlling said pressure to cause said hydraulically operated clutch to be engaged or disengaged in response to the predetermined engine operating condition.

28. A valve operation changing system as claimed in claim 27, wherein said hydraulically operated clutch includes a clutch piston member defining oppositely disposed first and second hydraulic clutch chambers which are respectively suppliable with a first pressure in connection with said first hydraulic pressure chamber and a second pressure in connection with said second hydraulic pressure chamber, said clutch piston member being axially movable in response to a difference between said first and second pressures, and a connecting member secured to said clutch piston member and movable to take a first position at which the connection between said timing lifter and said stopper member is capable of being established while, and, a second position at which the connection between said timing lifter and said stopper member is interrupted.

29. A valve operation changing system as claimed in claim 28, wherein said valve means includes a flow direction shifting valve which is shiftable to reverse the first and second pressures to be supplied to said first and second hydraulic clutch chambers of said hydraulically operated clutch in response to the predetermined engine operating condition.

30. A valve operation changing system as claimed in claim 1, wherein at least one of said cams has a plurality of cam faces which are separate from each other.

31. A valve operation changing system as claimed in claim 30, wherein said rocker arm is formed with a follower section having a plurality of contact faces at least one of which is contactable with the cam face of said first cam when said rocker arm is put in the first position while with the cam face of said second cam when said rocker arm is put in the second position.

32. A valve operation changing system as claimed in claim 31, wherein said first cam having a cam profile suitable for a first valve timing of the engine valve, said second cam having a cam profile suitable for a second valve timing of said engine valve, the first valve timing being different from the second valve timing.

33. A valve operation changing system as claimed in claim 32, wherein said plurality of cam faces are the same in cam profile.

34. A valve operation changing system as claimed in claim 33, wherein one of the cam faces of said first cam and the cam faces of said second cam are located side by side.

* * * * *